United States Patent [19]

Scott et al.

[11] Patent Number: 4,955,103

[45] Date of Patent: Sep. 11, 1990

[54] VACUUM CLEANER WITH SUCTION INDICATOR

[75] Inventors: Ernest R. Scott, Mayfield Heights; James C. Murphy, Broadview Heights, both of Ohio

[73] Assignee: The Scott Fetzer Company, Westlake, Ohio

[21] Appl. No.: 282,466

[22] Filed: Dec. 9, 1988

[51] Int. Cl.[5] ..... A47L 9/28

[52] U.S. Cl. ..... 15/319; 15/339; 15/354

[58] Field of Search ..... 15/319, 339, 354

[56] References Cited

U.S. PATENT DOCUMENTS

| | | | |
|---|---|---|---|
| 2,555,887 | 6/1951 | Kirby | 15/319 |
| 2,583,054 | 1/1952 | Kirby | 15/319 |
| 2,592,710 | 4/1952 | Kirby | 15/319 |
| 4,021,879 | 5/1977 | Brigham | 15/319 |
| 4,199,838 | 4/1980 | Simonsson | 15/339 |
| 4,245,370 | 1/1981 | Baker | 15/319 |
| 4,342,133 | 8/1982 | Minton | 15/339 |
| 4,481,692 | 11/1984 | Kurz | 15/339 |
| 4,692,754 | 9/1987 | Edejer et al. | 340/671 |
| 4,706,327 | 11/1987 | Getz et al. | 15/319 |
| 4,728,942 | 3/1988 | England | 340/679 |
| 4,731,898 | 3/1988 | Sovis et al. | 15/339 |

*Primary Examiner*—Chris K. Moore

*Attorney, Agent, or Firm*—Watts, Hoffmann Fisher & Heinke Co.

[57] ABSTRACT

A vacuum cleaner has an adjustable-height suction nozzle. A diaphragm switch is mounted in the housing inside the nozzle and determines a differential air pressure of the operating vacuum cleaner. Voltage source terminals are self-energizing with the rotation of a rotatable brush inside the nozzle and an indicator lamp is illuminated, or extinguished, upon developing a proper suction as establised by the proper adjusted height of the nozzle relative to the floor surface. The foregoing abstract is merely a resume of one general application, is not a complete discussion of all principles of operation or applications, and is not to be construed as a limitation on the scope of the claimed subject matter.

21 Claims, 3 Drawing Sheets

VACUUM CLEANER WITH SUCTION INDICATOR

BACKGROUND OF THE INVENTION

Vacuum cleaners have previously been proposed wherein there was an automatic height adjustment of the nozzle relative to the floor, such as shown in U.S. Letters Pat. Nos. 2,555,887; 2,583,054; 2,592,710: and 4,706,327. These were usually sufficiently complicated mechanisms that they were not commercially successful.

Vacuum cleaners have also been proposed utilizing a diaphragm to sense the amount of vacuum either to vary a resistance, as in U.S. Pat. No. 4,021,879, to slow the electric motor, or to actuate indicator lamps as disclosed in U.S. Pat. Nos. 4,199,838 and 4,481,692.

Other vacuum cleaners have been proposed which utilize some form of sensor to indicate when the filter bag is full and requires changing as in U.S. Pat. Nos. 4,199,838 and 4,342,133. Still other patents have had some form of indication of brush speed, either by a Hall effect sensor, as in U.S. Pat. No. 4,245,370, or by a magnet and sensor coil, as in U.S. Pat. Nos. 4,692,754 and 4,728,942.

SUMMARY OF THE INVENTION

The problem to be solved, therefore, is how to construct a vacuum cleaner with a suction indicator such that the proper height of an adjustable suction nozzle relative to the floor may be readily determined.

This problem is solved by a vacuum cleaner having a suction nozzle inlet for cooperation with a surface to be cleaned comprising, in combination, the height of the nozzle relative to a surface to be cleaned being variable, means to determine a differential air pressure of the operating vacuum cleaner, an electrical switch actuated in accordance with said differential pressure means, voltage source terminals, and indicator means connected electrically to said voltage source terminals and said switch.

The problem may further be solved by a vacuum cleaner comprising, in combination, a nozzle connected to said vacuum cleaner for cooperation with a surface to be cleaned, a rotatable brush in said nozzle, means to adjust the height of the nozzle relative to a surface to be cleaned, a permanent magnet on said rotatable brush, a pickup coil mounted in a stationary manner on said nozzle for cooperation with said rotatable permanent magnet to generate an alternating voltage, a diaphragm switch having a diaphragm and first and second electrical contacts, means connecting one side of said diaphragm to atmosphere, means connecting the other side of said diaphragm to the low pressure condition of said vacuum cleaner, an indicator, and means connecting said pickup coil to said diaphragm switch and said indicator.

The problem may still further be solved by a vacuum cleaner operating condition indicator with the vacuum cleaner having a rotatable brush in a heightadjustable nozzle comprising, in combination, a unitary housing, first and second indicator lights mounted in said housing, a diaphragm switch having a diaphragm and mounted in said housing, means mounting said housing in said height-adjustable nozzle with said indicator lights externally visible, means to apply the differential air pressure of the nozzle of the vacuum cleaner to opposite sides of said diaphragm, a pickup coil mounted in said housing and having a pole piece adapted for cooperation with a magnet rotatable with the brush of the vacuum cleaner, means connecting said pickup coil directly to said first indicator light to be illuminated upon sufficient brush rotational speed, and means connecting said pickup coil in series with said diaphragm switch and said second indicator light to change the indicator condition thereof upon proper spacing of the vacuum cleaner nozzle to a surface to be cleaned to establish the differential air pressure to actuate said switch.

Accordingly, an object of the invention is to provide a self-powered suction indicator which requires no electrical connection from the motor or the energization source of the motor. Accordingly, such suction indicator may be used with a vacuum cleaner having a removable nozzle without need for disconnecting any electrical connections.

A feature of the invention is to provide a small housing which fits within the suction nozzle of an upright vacuum cleaner. This nozzle also contains a rotatable brush, and the rotation of the brush is utilized to develop a voltage to energize the suction indicator. In this manner, the indicator may have two functions of indicating proper rotation of the brush, and also providing power to indicate the proper amount of suction developed when the adjustable nozzle is at the most advantageous spacing from the floor or other surface to be cleaned. A diaphragm switch is utilized to be actuated between ON and OFF conditions, depending on the amount of suction developed in the nozzle relative to the ambient. The small housing may be completely concealed within the nozzle of the vacuum cleaner and the indicator be visible externally of the nozzle. The indicator may be indicator lamps for brush rotation speed and for proper amount of suction for most effective cleaning.

Other objects and a fuller understanding of the invention may be had by referring to the following description and claims, taken in conjunction with the accompanying drawing.

DESCRIPTION OF THE PREFERRED EMBODIMENT

Figure 1:
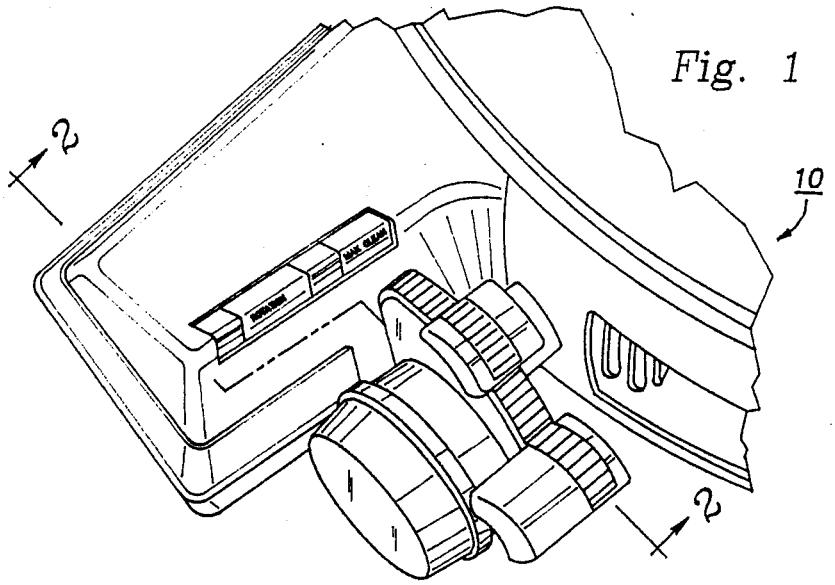
FIG. 1 is a perspective view of a part of a vacuum cleaner embodying the invention.

The figures of the drawing illustrate a vacuum cleaner 10 which may be a canister or tank-type, but has been illustrated as an upright household electric vacuum cleaner having a motor enclosure 11 and an adjustable-height suction nozzle 12. In this preferred embodiment, the nozzle 12 is also removable by releasing a latch 13. This exposes a drive shaft 14 from the motor 15. This motor may be the usual electric motor energized from a source of commercial power frequency (not shown) and the motor drives a fan 16, acting in this case as a suction pump to establish a suction through a suction conduit 17 of the nozzle 12 at the area of attachment to the motor enclosure 11. This suction or region of lowered air pressure is present within the nozzle 12 and draws air through the nozzle inlet opening 18. The nozzle 12 also contains a rotatable brush 20 which is driven through a belt 21 from the drive shaft 14, and should rotation of the brush be blocked with the motor running, the drive train for the brush is capable of slipping, e.g., slipping at the junction of the belt 21 and shaft 14.

The height or spacing of the nozzle relative to the floor or other surface to be cleaned is variable. A height-adjustment mechanism of a known type may be utilized, such as that disclosed in U.S. Pat. No. 4,078,275, the disclosure of which is hereby incorporated by reference. The exact type of height-adjusting nozzle mechanism is not critical, and the mechanism shown in the aforementioned patent is merely illustrative of one of many height-adjusting mechanisms. This mechanism incorporates generally a pedal 24 which, when depressed to the phantom position, lowers a skid or wheel 25 which supports the vacuum cleaner 10 relative to the floor. By so depressing the pedal 24 around the pivot shaft 26, the wheel is lowered and the vacuum cleaner suction nozzle 12 is raised to its maximum extent. In this position, the air readily is admitted to the suction nozzle inlet 18 so that the vacuum or lowered air pressure within the nozzle 12 is of a low value. An escapement pedal 27 may be repeatedly depressed against the urging of a spring 28 to release an escapement pawl 29 relative to a ratchet 30. Each depression of the escapement pawl 29 lowers the suction nozzle inlet incrementally until the suction inlet 18 is resting on the floor. With the suction inlet completely closed off, a considerable vacuum may be developed inside the nozzle 12 by the fan 16. For example, this might be in the order of 12 to 15 inches of water as a differential air pressure relative to the ambient. It has been found that if the nozzle 12 is closely spaced off the rug or other surface to be cleaned, a desirable high rate of air flow is created between the nozzle inlet and through the pile of the carpeting for a maximum cleaning effect, and this could result in a pressure differential equal only to two or three inches of water instead of the full nozzle down pressure of 12 to 15 inches of water. Such nozzle height will vary in accordance with the type of surface, whether it be a plush, medium, low, loop, sculptured, or undulating pile type carpet, a hard surface bare floor, and the like, but two to three inches of water as a differential air pressure has been found to be the best suction cleaning condition for most dirty air-type upright cleaners for general home cleaning, and may be higher for clean air uprights, canisters, and central vacuum units.

Figure 2:
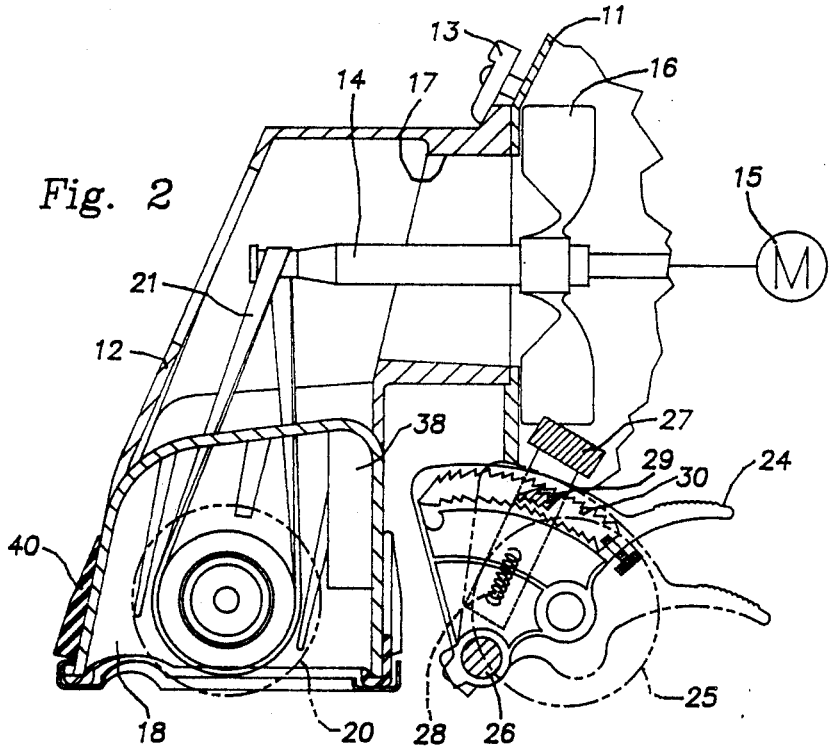
FIG. 2 is a sectional view on line 2—2 of FIG. 1.
Figure 3:
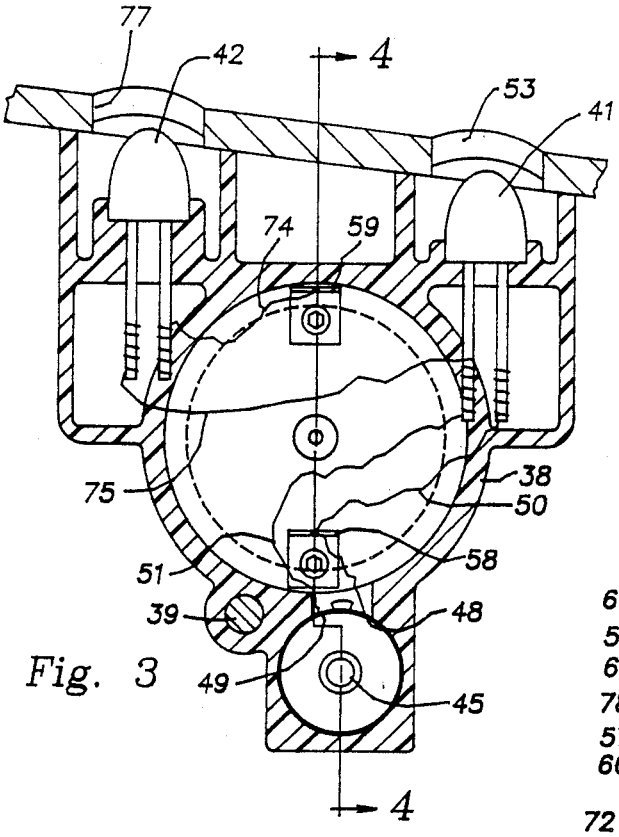
FIG. 3 is a front elevational view of an indicator housing.
Figure 4:
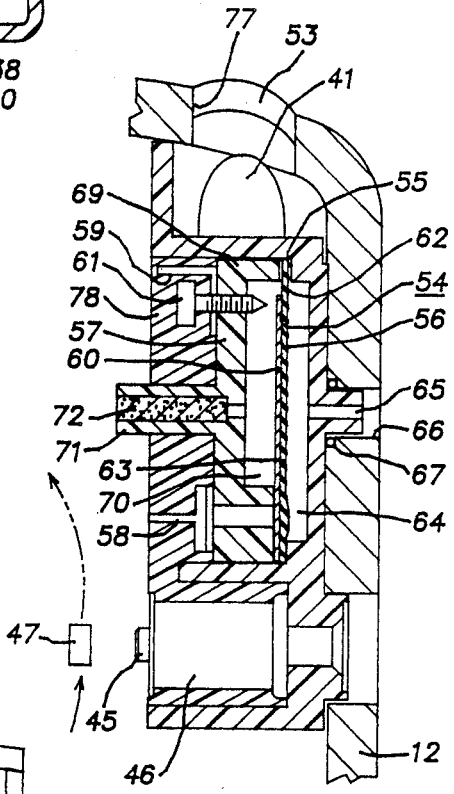
FIG. 4 is a sectional view on line 4—4 of FIG. 3.
Figure 5:
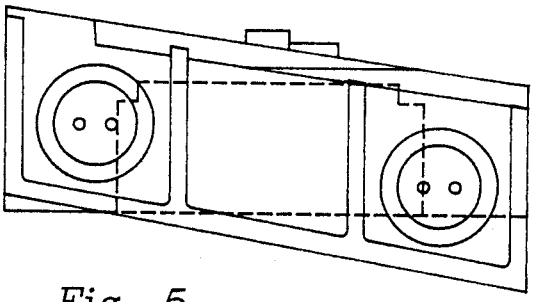
FIG. 5 is a top plan view of the housing of FIG. 3.

An indicator housing 38 is mounted against the rear wall of the nozzle 12 by a single screw 39, the screw being normally hidden beneath a rubber bumper 40. FIGS. 3, 4, and 5 better show the construction of the indicator housing 38 and FIG. 2 shows generally its position within the nozzle 12. The housing 38 has first and second indicators 41 and 42, shown as lamps, to indicate brush rotation and the best suction condition, respectively. The housing 38 is a unitary housing of some insulating material, such as plastics. A pole piece 45 is fixed in the housing 38, with a pickup coil 46 surrounding this pole piece. With the housing 38 mounted within the nozzle 12, the pole piece is positioned close to the rotating brush 20, on which a permanent magnet 47 is located to sweep past the pole piece 45 and develop a voltage at voltage source terminals 48 and 49 upon rotation of the brush 20. These voltage source terminals 48 and 49 are connected by conductors 50 and 51 to the first indicator lamp 41 to illuminate this lamp upon rotation of the brush. This lamp is visible behind a transparent or translucent lens 53, as shown in FIG. 1, and indicates rotation of the brush. Should the adjustable nozzle 12 be positioned too closely to the surface to be cleaned, the rotatable brush may strike the carpet or other material, slowing, or even stopping, such brush due to the slippable drive train, with slipping primarily between the belt 21 and the motor shaft 14. In such case, a voltage ceases to be produced at the voltage source terminals 48 and 49, and the indicator lamp 41 will be extinguished.

A diaphragm switch 54 is mounted within the housing 38, and is an electrical switch responsive to the operating condition of the vacuum cleaner 10. In this embodiment, it is responsive to a suction condition, namely, the lower air pressure within the nozzle 12 relative to the ambient. The housing 38 has a circular shoulder 55 against which a first face 62 of a circular, flexible diaphragm 56 is located. An insert 57 of solid insulating material is located in the housing 38 and in engagement with a second face 63 of the diaphragm 56. A first terminal 58 is fixed on the insert 57, and is secured to a metal contact disc or blade 60 on the second face 63 of the diaphragm to be deflectable therewith. A second terminal 59 is mounted on the insert 57 and, as shown, may be adjustable by having an adjustment screw 61 passing through the insert to be selectively engageable by the contact disc 60.

The shoulder 55 of the housing 38 cooperating with the first face 62 of the diaphragm 56 creates a first pressure chamber 64. In this embodiment, this first pressure chamber is open to the ambient by means of a port 65, which extends through an aperture 66 in the wall of the nozzle 12. An optional O-ring 67 may be used to prevent air leakage at this aperture 66. The insert 57 has an annular flange 69 which is sealed to the second face 63 of the diaphragm 56 to establish a second pressure chamber 70. This second pressure chamber is exposed to a lower pressure operating condition of the operating vacuum cleaner 10 by means of a conduit 71 which is exposed to the lower air pressure inside the nozzle 12. A filter 72 is provided inside the conduit 71 to help keep dust and other contaminants from inside the pressure chamber 70. This filter 72 is preferably removable for cleaning, and the conduit 71 is aligned with the contact disc 60. This provides physical protection to the flexible diaphragm 56 so that should someone poke a pin or other object into the conduit 71 for cleaning, it will not puncture the diaphragm 56.

The terminals 58 and 59 of the diaphragm switch 54 are connected in circuit with the voltage source terminals 48 and 49. The voltage source terminal 48 is connected to the terminal 58 by the conductor 50. The circuit proceeds through the diaphragm switch from terminal 58 to 59, and then, by a conductor 74, to the second indicator lamp 42. The other lead of this lamp is connected by a conductor 75 and conductor 51 to the voltage source terminal 49. By this connection, when the diaphragm switch 54 is closed, the voltage source terminals 48 and 49 will illuminate the second indicator lamp 42.

When the vacuum cleaner 10 is first turned on for use, the operator may depress the pedal 24 to raise the nozzle 12 to its maximum height relative to the floor. With the motor 15 energized and running, the rotatable brush 20 will be rotating at approximately its maximum speed because the brush will not be in contact with the carpet, and also the nozzle inlet opening 18 will be considerably spaced from the floor surface to offer little obstruction to intake of air. The rotating permanent magnet 47 will then generate a voltage at the voltage source terminals 48 and 49, and the first indicator lamp 41 will be illuminated, for example, with a green light, to indicate rotation of the rotatable brush 20. Should this light not be illuminated, it might indicate a jammed brush or broken belt 21. Thus, the operator of the vacuum cleaner is alerted to any defective conditions. Next, the escapement pedal 27 should be progressively depressed to gradually incrementally lower the nozzle 12 toward the floor surface. This will increasingly choke off intake of air as the nozzle inlet opening 18 moves downwardly toward the correct operating position of the adjustable height nozzle. At the proper operating height, the rotatable brush 20 will be brushing the carpet, and the inlet opening 18 will be sufficiently restricted to develop a low pressure area inside the nozzle 12 of approximately two to three inches of water. The height of the nozzle relative to the floor surface for this proper operating condition will vary in accordance with the type of floor surface, but with this two to three inches of water as a differential air pressure, the flexible diaphragm 56 will be deflected sufficiently that the contact disc 60 engages the adjustable screw 61. This closing of the switch will illuminate the second indicator lamp 42, which may be a red indicator lamp, for example, visible behind a lens as shown in FIG. 1. This will be a readily visible indication to the operator of the vacuum cleaner that the adjustable height nozzle is set for maximum cleaning efficiency for the particular type of floor surface.

An alternative mode of operation could also be employed, as follows. With the suction inlet completely closed against the surface to be cleaned, a considerable vacuum inside the nozzle will be developed by the motor-fan system. For example, it could be as high as 15 inches of water lift as a pressure differential. Although there will be a small amount of air flow through the carpet pile, it would not be sufficient to do a good cleaning job. The second indicator light 42, possibly red in color, will be lighted due to the diaphragm pressure switch closing, thus indicating poor cleaning. Raising the nozzle incrementally would cause the light 42 to extinguish, at which point the differential of pressure will have dropped off and air flow permitted to increase, providing maximum cleaning condition.

Figure 6:
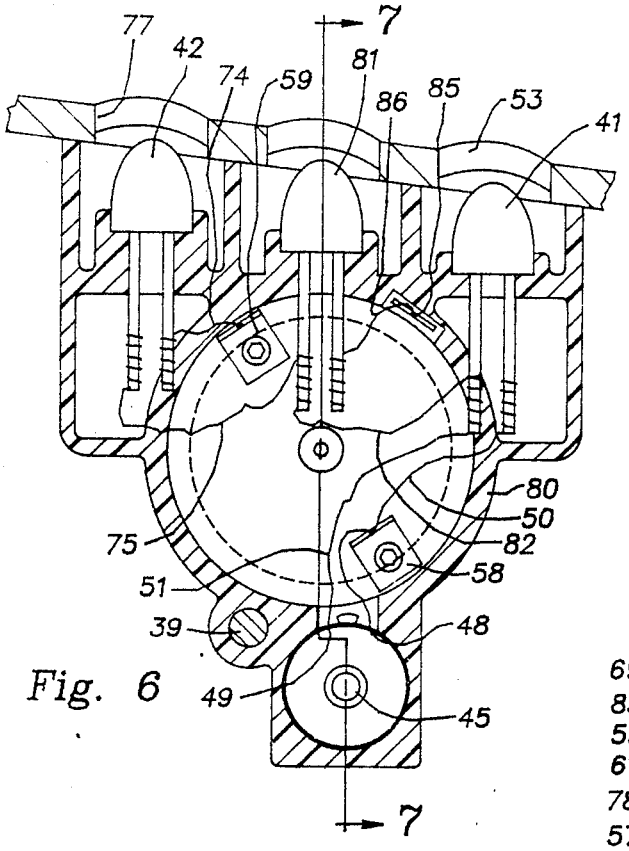
FIG. 6 is a front elevational view, similar to FIG. 3, of an alternative embodiment of the invention.
Figure 7:
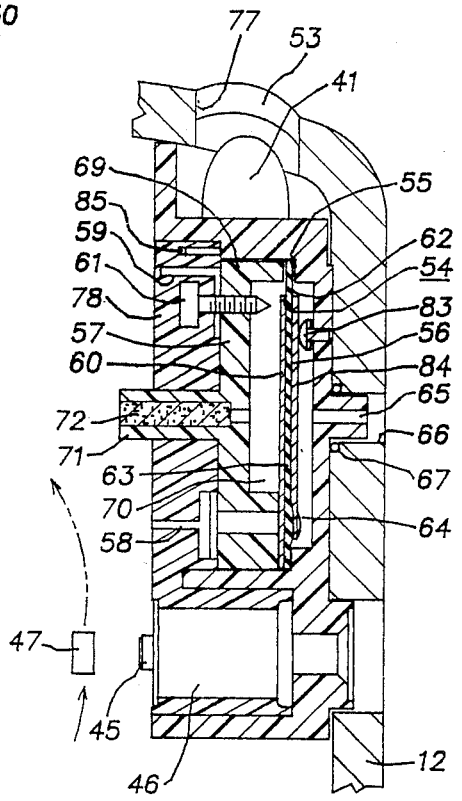
FIG. 7 is a sectional view on line 7—7 of FIG. 6.

A third embodiment is illustrated in FIGS. 6 and 7 as an indicator housing 80, with reference numerals the same as in FIGS. 3 and 4 for the same parts. A third indicator 81 is added, which may be yellow or orange. This indicator is energized by conductor 75 and a new conductor 82 leading to voltage source terminal 49. A second contact 83 is normally closed against a diaphragm contact blade 84 on the atmospheric side of the diaphragm 56. Contact 83 is connected to a terminal 85, which is connected by a conductor 86 to the indicator 81.

In operation, the indicator 41 would be the rotation indicator, as before. The indicator 42 would again be a red lamp. With the cleaner turned "on" and brush roll running and nozzle height fully up, the brush roll turn indicator 41 would be lighted as before, but so would the orange/yellow light 81. Lowering the nozzle incrementally to the desired height would turn the red light 42 on and orange/yellow light 81 off. This is functionally the same as the concept in the first embodiment, except that the third light 81 indicates to the operator that the nozzle is too high to clean properly.

It will be noted that the voltage source terminals 48 and 49 are capable of developing a voltage when the nozzle 12 is attached to the motor enclosure 11 and the brush 20 rotates. The nozzle 12 is removable from the motor enclosure 11, and there are no electrical connections between the motor enclosure 11 and nozzle 12. Thus, the nozzle 12 may be removed so that the motor shaft 14 and/or suction fan 16 may be used for other applications. The indicator means 41, 42 and 81 and the voltage source terminals 48 and 49 are mounted in the removable nozzle 12, with an absence of all electrical connections from the motor enclosure to the nozzle. The rotating permanent magnet 47 is a means to develop a voltage in cooperation with the pickup coil 46 in accordance with rotation of the brush 20. The indicator housing 38 or 80 is small and easily mounted inside the nozzle 12 by the single screw 39. The port 65 passing through the aperture 66 helps orient the housing 38 for proper positioning. The housing is therefore hidden inside the nozzle 12, but the indicator lamps 41, 42, and 81 are visible externally of the nozzle 12 to the vacuum cleaner operator through apertures such as apertures 77 in the top of the nozzle 12. A curable plastics material 78 may be filled inside the housing 38 to cover the insert 57 and help seal the insert to the diaphragm 56 and also to provide protection to the relatively small gauge conductors 50, 51, 74, and 75. This makes a rugged housing which is sealed except for the port 65 and conduit 71 for easy handling during production and assembly.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and of the circuit and the combination and arrangement of parts and circuit elements may be resorted to without departing from the spirit and the scope of the invention as hereinafter claimed.

What is claimed is:

1. A vacuum cleaner having a suction nozzle inlet for cooperation with a surface to be cleaned, comprising in combination:

means for variably adjusting the height of the nozzle relative to a surface to be cleaned;

means to sense a differential air pressure between that of the atmosphere and that within the nozzle of the operating vacuum cleaner;

an electrical switch actuated in response to said differential pressure sensing means sensing a predetermined level of differential pressure;

a voltage source including terminals on the nozzle; and indicator means connected electrically to said voltage source terminals through said switch whereby said indicator indicates to the operator that the height adjustment of the nozzle is proper due to the magnitude of the differential pressure a suction for most effective cleaning.

2. The vacuum cleaner as set forth in claim 1, including a rotatable brush driven by a motor through a slippable drive; and means to develop a voltage at said voltage source terminals in response to rotation of the brush and with no electrical connection to the motor or to the energization source of the motor.

3. The vacuum cleaner as set forth in claim 1, including an electric motor energizable from a commercial frequency power source, the motor driving a fan to create a suction, said motor being in an enclosure with said nozzle being removable therefrom, there being an absence of all electrical connections from said motor enclosure to said nozzle; and said indicator means and voltage source terminals being mounted in said removable nozzle.

4. The vacuum cleaner as set forth in claim 3, including a rotatable brush in said nozzle; and means to develop a voltage at said voltage source terminals in response to rotation of said brush.

5. The vacuum cleaner as set forth in claim 1, wherein said differential air pressure sensing means is mounted within said nozzle and is responsive to the difference in air pressure between said nozzle and the ambient.

6. The vacuum cleaner as set forth in claim 1, wherein said differential pressure sensing means includes a deflectable diaphragm; and said electrical switch being operable by said diaphragm.

7. A vacuum cleaner comprising, in combination:

a nozzle connected to said vacuum cleaner for cooperation with a surface to be cleaned;

a rotatable brush in said nozzle;

means to adjust the height of the nozzle relative to a surface to be cleaned;

a permanent magnet on said rotatable brush;

a pickup coil mounted in a stationary manner on said nozzle for cooperation with said rotatable permanent magnet to generate an alternating voltage;

a diaphragm switch having a diaphragm and first and second electrical contacts;

means connecting one side of said diaphragm to atmosphere;

means connecting the other side of said diaphragm to the air flow circuit within said vacuum cleaner;

a voltage energized indicator;

means connecting said pickup coil to said indicator through said diaphragm switch to energize said indicator, whereby said indicator indicates to the operator that the height adjustment of the nozzle is proper due to a predetermined difference existing between atmospheric pressure and pressure within the air flow circuit with a suction for most effective cleaning.

8. A vacuum cleaner as set forth in claim 7, wherein said indicator is a lamp.

9. A vacuum cleaner as set forth in claim 7, including a housing for said pickup coil, diaphragm switch, and indicator.

10. A vacuum cleaner as set forth in claim 9, including means to secure said housing to said nozzle.

11. A vacuum cleaner as set forth in claim 9, including means to secure said housing within said nozzle, with said indicator being visible externally of said nozzle.

12. A vacuum cleaner as set forth in claim 7, wherein said indicator is energized upon the nozzle being height-adjusted to within a maximum distance from the surface to be cleaned.

13. A vacuum cleaner as set forth in claim 7, wherein said indicator is de-energized upon the nozzle being height-adjusted more than a maximum distance away from the surface to be cleaned.

14. A vacuum cleaner operating condition indicator with the vacuum cleaner having a rotatable brush in a height-adjustable nozzle, comprising, in combination;

a unitary housing;

first and second indicator lights mounted in said housing;

a diaphragm switch having a diaphragm and mounted in said housing;

means mounting said housing in height-adjustable nozzle with said indicator lights externally visible;

means to apply the differential air pressure of the nozzle of the vacuum cleaner to opposite sides of said diaphragm;

a pickup coil mounted in said housing and having a pole piece adapted for cooperation with a magnet rotatable with the brush of the vacuum cleaner;

means connecting said pickup coil directly to said first indicator light to be illuminated in response to brush rotational speed; and means connecting said pickup coil in series with said diaphragm switch and said second indicator light to change the indicator condition thereof upon proper spacing, with a suction for most effective cleaning, of the vacuum cleaner nozzle to a surface to be cleaned to establish the differential air pressure to actuate said switch.

15. A vacuum cleaner operating condition indicator as set forth in claim 14, including said diaphragm being flexible;

means sealing a first face of said diaphragm to said housing; and an insert secured to said housing and having an annular shoulder sealed to said second face of said diaphragm to form a low pressure chamber.

16. A vacuum cleaner operating condition indicator as set forth in claim 15, including a movable contact mounted to be actuated by said diaphragm and electrically connected to a first switch terminal; and a second switch terminal mounted on said insert.

17. A vacuum cleaner operating condition indicator as set forth in claim 14 wherein said differential air pressure applying means includes conduit means to apply the lower air pressure within the nozzle to the one side of said diaphragm.

18. A vacuum cleaner operating condition indicator as set forth in claim 17, including a filter in said conduit means.

19. A vacuum cleaner operating condition indicator as set forth in claim 17, including a metal contact on the low pressure one side of said diaphragm as part of said switch.

20. A vacuum cleaner operating condition indicator as set forth in claim 19, wherein said conduit means is aligned with said contact for physical protection for said diaphragm.

21. A vacuum cleaner operating condition indicator as set forth in claim 14, including:

a third indicator light in said housing; and a third electrical contact on the other side of said diaphragm connecting said third indicator light to said pickup coil.

* * * * *